United States Patent [19]

Spirig

[11] 4,241,338

[45] Dec. 23, 1980

[54] AMBIENT NOISE INTRUDER ALARM

[76] Inventor: Ernst Spirig, P.O. Box 160, Speerstrasse 14, CH-8640 Rapperswil, Switzerland

[21] Appl. No.: 36,454

[22] Filed: May 7, 1979

[30] Foreign Application Priority Data

May 15, 1978 [GB] United Kingdom ..... 19603/78

[51] Int. Cl.[3] ..... G08B 13/16

[52] U.S. Cl. ..... 340/566; 307/117; 340/550; 367/93

[58] Field of Search ..... 340/566, 550, 565, 507, 340/508, 541; 307/117; 367/93

[56] References Cited

U.S. PATENT DOCUMENTS 3,109,165 10/1963 Bagno ..... 340/566
3,721,972 3/1973 Hermans ..... 340/550
4,086,586 4/1978 Spirig ..... 340/550

*Primary Examiner*—Glen R. Swann, III
*Attorney, Agent, or Firm*—Lawrence E. Laubscher

[57] ABSTRACT

Two receivers arranged inside and outside a closed space, respectively, are responsive to ambient or environmental noise and a comparator provides an alarm signal when the difference between the outputs of the two receivers falls below a threshold, thereby indicating that the wall to the space has been breached. Alternatively, the two receivers may be arranged in spaced relation within the space and the comparator provides the alarm signal when the difference between the two outputs rises above a threshold, thereby indicating that an intruder is present and closer to one receiver than the other. The apparatus consumes little energy during the watch period and does not depend on itself radiating energy.

7 Claims, 5 Drawing Figures

AMBIENT NOISE INTRUDER ALARM

BRIEF DESCRIPTION OF THE PRIOR ART

This invention relates to syystems for providing an alarm when an intruder enters a closed space being supervised. The invention particularly aims to provide an intruder alarm apparatus which consumes a minimal amount of energy when in "watch" condition, that is to say, whilst the integrity of the closed space remains unbroken.

Known intruder alarms include systems which employ a transmitter and a receiver and means for issuing an alarm indication when the signal received at the receiver rises above or falls below a threshold level. The transmitter emits continuously throughout the watch periods, or at least for the major portions of such watch periods. Accordingly, these systems consume considerable energy during the watch periods. Also, the atmosphere is polluted with a considerable quantity of energy from the transmitter, for example ultra-sound if the apparatus uses ultrasonic waves.

In accordance with this invention, there is provided an intruder alarm apparatus for producing an alarm when an intruder enters a closed space being supervised, comprising a first and second receivers of ambient or environmental noise, and a comparator arranged to provide an alarm when the integrity of the closed space is broken so that the difference between the outputs of the two receivers falls below or rises above a threshold level. The receivers may be disposed respectively inside and outside the closed space, to respond when said difference falls below said level. Alternatively, the first and second receivers may be disposed within the closed space and spaced several paces apart. If an intruder has entered the closed space, and then comes closer to one receiver than the other, the outputs of the two receivers will differ and the alarm is produced when this difference exceeds the threshold.

Energy is saved during the watch condition because there is no transmitter to drive. Thus the system is entirely passive. The ambient or environmental noises relied upon may be of any region and may be in any frequency range, whether audible or not, propagated by air.

BRIEF DESCRIPTION OF THE DRAWING

Embodiments of this invention will now be described, by way of examples only, with reference to the accompanying drawing, in which.

DETAILED DESCRIPTION

Figure 1:
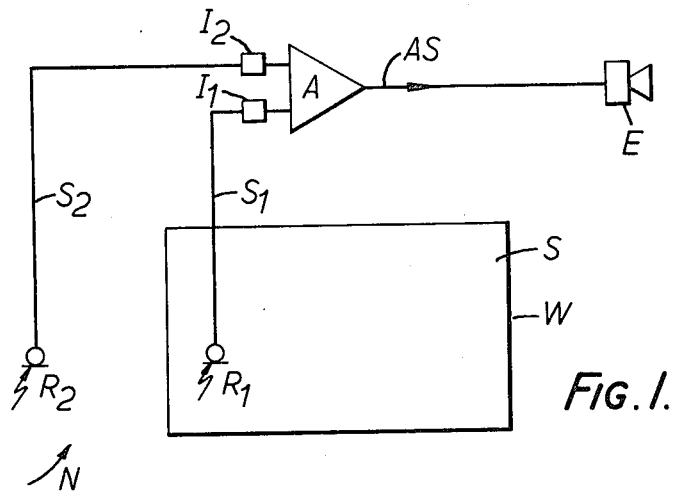
FIG. 1 is a schematic diagram of an intruder alarm apparatus supplied to an enclosed space.

Referring to FIG. 1, a wall W encloses a space S which is to be supervised. First and second receivers $R_1$ and $R_2$ are placed respectively inside and outside the space S and their outputs are applied to a differential amplifier A acting as a comparator.

The noise N which is naturally present in the atmosphere reaches the external receiver $R_2$ directly, but only reaches the internal receiver $R_1$ through the wall W, and is greatly attenuated. However, if the wall W is branched by an intruder, then the ambient noise reaching the internal receiver $R_1$ is no longer attenuated so much. The amplifier A is responsive to the difference between the outputs from the two receivers and is arranged to provide an output alarm signal AS when the difference $\Delta S$ between the outputs $S_1$ and $S_2$ falls below a threshold value, the alarm signal energizing means E emitting an audible or visual alarm.

Figure 2A:
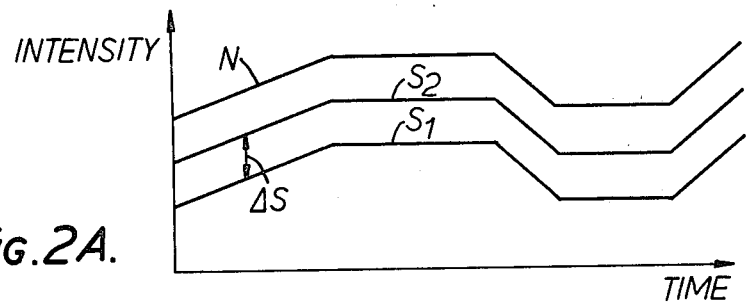
FIGS. 2A and 2B comprise a series of graphs for explaining the operation of the apparatus of FIG. 1.

FIG. 2*a* shows how variations in the intensity of the ambient noise N are followed synchronously by the outputs $S_1$ and $S_2$ of the respective receivers $R_1$ and $R_2$, assuming that the integrity of the closed space is maintained. The difference $\Delta S$ remains constant.

Figure 2B:
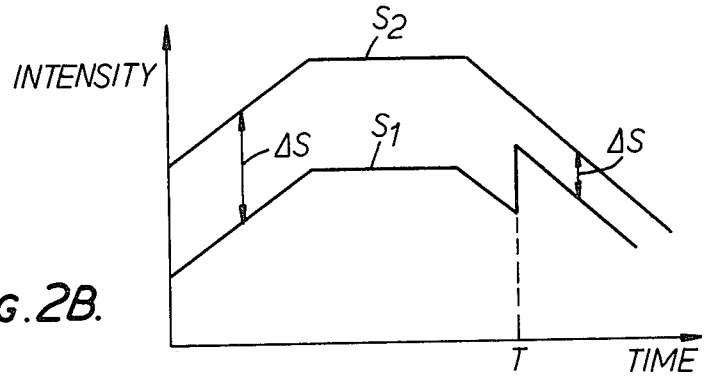

FIGS. 2*b* shows the corrresponding variations occurring when the wall W is breached. The reduction in $\Delta S$ occurring at the time T of break-in produces the alarm signal. The disabling of either receiver may also produce an alarm signal, by producing a change in $\Delta S$ beyond preset limits.

Figure 4:
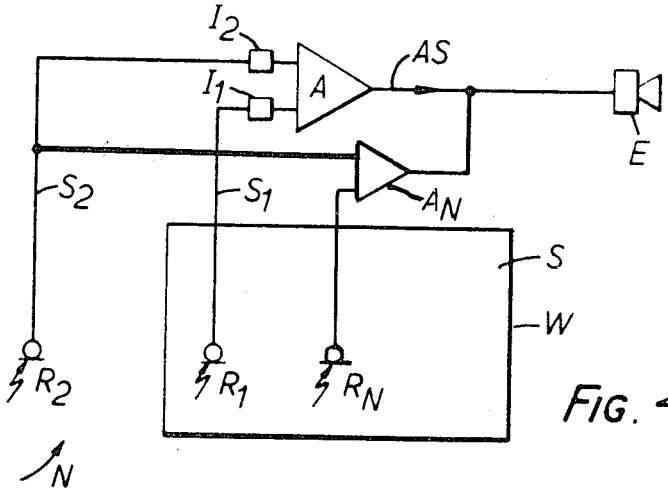

The apparatus may include two or more receivers. These may respond preferentially on specific frequencies, whether sonic or ultrasonic, being chosen in dependence upon the transmission characteristics of the particular material of which wall W is made. Thus, FIG. 4 shows a third receiver $R_N$ and a comparator $A_N$ for comparing its output with the output of receiver $R_2$ and any alarm signal from comparator $A_N$ is supplied to means E.

The or each differential amplifier may include integrators to establish average noise levels, so that only differences between the average noise levels will be responded to by the amplifier. Thus, transient noise bursts will not cause false alarms, for example where a noise burst is delayed by the wall and reaches the internal receiver after the external receiver. Integrators $I_1$ and $I_2$ are shown for amplifier A.

The radio or tape player of a car may be adapted to form this type of alarm apparatus.

If there is insufficient ambient noise, artificial noise may be transmitted, perhaps at a preferred frequency.

It will be appreciated that the receiver $R_1$ need not be fully enclosed.

Figure 3:
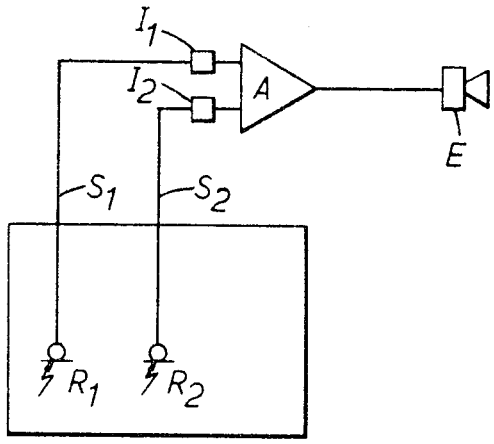
FIGS. 3 and 4 are schematic diagrams of second and third embodiments, respectively, of the invention.

In an alternative arrangement shown in FIG. 3, two receivers $R_1$ and $R_2$ are disposed within a space S to be protected, spaced several paces apart. An intruder coming closer to one receiver will cause a change in the output thereof, the other received remaining stable. It is unlikely that the intruder will follow such a path as to always cause equal changes in the outputs of the two receivers. An alarm is given when the outputs of the two receivers, as compared by the comparator, indicate that the noise intensities received by the respective receivers differ by greater than a threshold value. Preferably the system operates on high frequencies so that small noise changes will cause significant output signal variations at the respective receivers.

I claims:

1. An intruder alarm apparatus for producing an alarm when an intruder enters a closed space being supervised, comprising first and second receivers (R1, R2) each having an output terminal, said receivers being responsive to ambient noise transmitted through the air;

nornally de-activated alarm means (E); and comparator means (A) having a pair of input terminals connected with the output terminals of said receivers, respectively, and an output terminal connected with said alarm means, said comparator means being operated to activated said alarm means when the difference between the output signals of said receivers deviates from a given threshold value.

2. An intruder alarm apparatus as claimed in claim 1, which the two receivers are disposed respectively inside and outside the closed space and the alarm is produced when the difference between the outputs of the two receivers falls below said threshold level.

3. An intruder alarm apparatus as claimed in claim 1, in which the two receivers are disposed within the closed space and spaced several paces apart and the alarm is produced when the difference between the outputs of the two receivers rises above said threshold level.

4. An intruder alarm apparatus as claimed in claim 1, in which respective integrators are connected between the outputs of said receivers and the comparator inputs.

5. An intruder alarm apparatus as claimed in claim 1, in which the comparator comprises a differential amplifier.

6. An intruder alarm as claimed in claim 1, in which at least a third receiver is provided, with its output and the output of the first receiver connected to a second comparator.

7. An intruder alarm as claimed in claim 6, in which the second and third receivers respond preferentially on different frequencies.

* * * * *